US007100319B2

(12) United States Patent
Paige

(10) Patent No.: US 7,100,319 B2
(45) Date of Patent: Sep. 5, 2006

(54) PRISMATIC BORESIGHTER

(75) Inventor: Clive Rawlinson Paige, Shenzhen (CN)

(73) Assignee: Optics Research (HK) LTD, Hong Kong (CN)

( * ) Notice: Subject to any disclaimer, the term of this patent is extended or adjusted under 35 U.S.C. 154(b) by 242 days.

(21) Appl. No.: 10/773,402

(22) Filed: Feb. 9, 2004

(65) Prior Publication Data

US 2004/0244262 A1 Dec. 9, 2004

Related U.S. Application Data

(60) Provisional application No. 60/446,536, filed on Feb. 12, 2003.

(51) Int. Cl.
*F41G 3/00* (2006.01)

(52) U.S. Cl. ..... 42/120; 42/121; 42/130; 33/286; 33/298

(58) Field of Classification Search ..... 42/120, 42/121, 130; 33/286, 298
See application file for complete search history.

(56) References Cited

U.S. PATENT DOCUMENTS

| | | | | |
|---|---|---|---|---|
| 3,744,133 | A * | 7/1973 | Fukushima et al. | 42/121 |
| 4,390,276 | A * | 6/1983 | Budden et al. | 356/251 |
| 5,222,302 | A * | 6/1993 | DeBatty et al. | 42/121 |
| 5,486,913 | A * | 1/1996 | Aharon | 356/153 |
| 6,176,019 | B1 * | 1/2001 | Frear, Jr. | 42/120 |
| 6,332,286 | B1 * | 12/2001 | Shen | 42/121 |
| 6,513,275 | B1 * | 2/2003 | Paige | 42/120 |

* cited by examiner

*Primary Examiner*—J. Woodrow Eldred

(57) ABSTRACT

An optical collimator device, for use in aligning a riflescope with the bore of the rifle, is formed using a small aperture lens for viewing a reticule through a prismatic assembly. The collimator is magnetically attached to the muzzle of the rifle, and when a target is viewed through the riflescope the image of the reticule and the riflescope cross wires are seen simultaneously with the image of the target.

6 Claims, 3 Drawing Sheets

PRISMATIC BORESIGHTER

BACKGROUND TO THE INVENTION

The present invention relates to bore sight collimators that are used to align a sight with the bore of a gun.

At present an optical boresighter uses an optical collimating system consisting of a lens that is optically aligned with a reticule marked on a glass plate, positioned at the focal plane of the lens. The lens and the reticule plate are mounted at either end of a housing.

The alignment of the collimator housing to the bore of the gun is achieved by use of a close fitting pin inserted into the end of the barrel, to which the collimator housing is clamped. Alternatively a magnetic strip is built into to the collimator housing, such that the collimator can be attached to the end of a gun barrel magnetically. The end of the barrel is by necessity, square with the bore, and this gives the necessary alignment.

In both these systems the optical element of the collimator is relatively large, it is similar to, or larger in size, to the objective lens of a riflescope. When the collimator is viewed with a riflescope, only the collimator reticule and the riflescope cross wires can be seen.

A large aperture of the optical element requires the optical path length to be long and consequently the collimator housing is large.

To prevent internal fogging, the void between the lens and the reticule plate is usually filled with dry Nitrogen gas, and the housing is usually of metal construction to contain the gas, which results in a relatively heavy unit.

BRIEF SUMMARY OF THE INVENTION

It is the object of this invention to provide a substantially smaller, lightweight and fog-proof collimator system, that has benefits and improved performance over other available systems as described.

The present invention is an optical collimator device for use in aligning a riflescope with the bore of a rifle. The construction is designed with a prismatic element between the magnifying lens and the reticule. It uses the prismatic element to fold the optical path length to make the system compact, and uses a magnetic strip to attach the collimator to the muzzle of a rifle barrel, allowing vertical height adjustment for various sight designs.

The optical design provides a much smaller lens and an increased focal length to lens aperture ratio, this ratio is typically greater than 6, where as alternative systems use a ratio of typically 3, so that when the design is used with a magnifying riflescope, the design allows the simultaneous viewing of the target and the reticule pattern in conjunction with the riflescope cross wires.

The ability to see the target with the reticule pattern image is of great benefit to the user, as the point of impact on the target can be seen with the reticule pattern, and allows the sight cross wires to be adjusted to the point of impact, while the reticule pattern is still centred on the target. This allows one shot zeroing, which is not possible with other systems.

The reticule can also be used a range scale for distance calculation and direct measurement of bullet drop and placement.

The use of a much smaller aperture lens (approximately one quarter of a standard design) with double the normal focal length gives better optical performance, as the placement of the reticule at the lens focal plane is not as critical as other systems, and spherical and chromatic aberrations are dramatically reduced, and the use of an achromatic lens design, which is a standard requirement on other systems, is no longer required. This dramatically reduces production costs.

DETAILED DESCRIPTION OF THE PREFERRED EMBODIMENT

According to the present invention there is provided an optical collimator device with a reticule pattern placed optically at infinity, characterised in that a magnifying optical element is placed in front of it along the optical path to enable the reticule pattern to be seen with the naked eye.

The optical path between the reticule pattern and the magnifying optic is transmitted through a block of optically transparent material forming a rhomboid prism. The optical path is aligned by internal reflecting surfaces at two positions so as to fold the optical path, the longer part of the optical path is arranged to be perpendicular to the barrel of the rifle forming a compact arrangement.

There is also provided a magnetic strip that enables the mounting of the device onto the muzzle of a barrel, permitting vertical adjustment of the collimator. The magnetic strip is directly mounted to the long section the prism for rigidity and compactness.

Figures 1A, 1B, 1C:
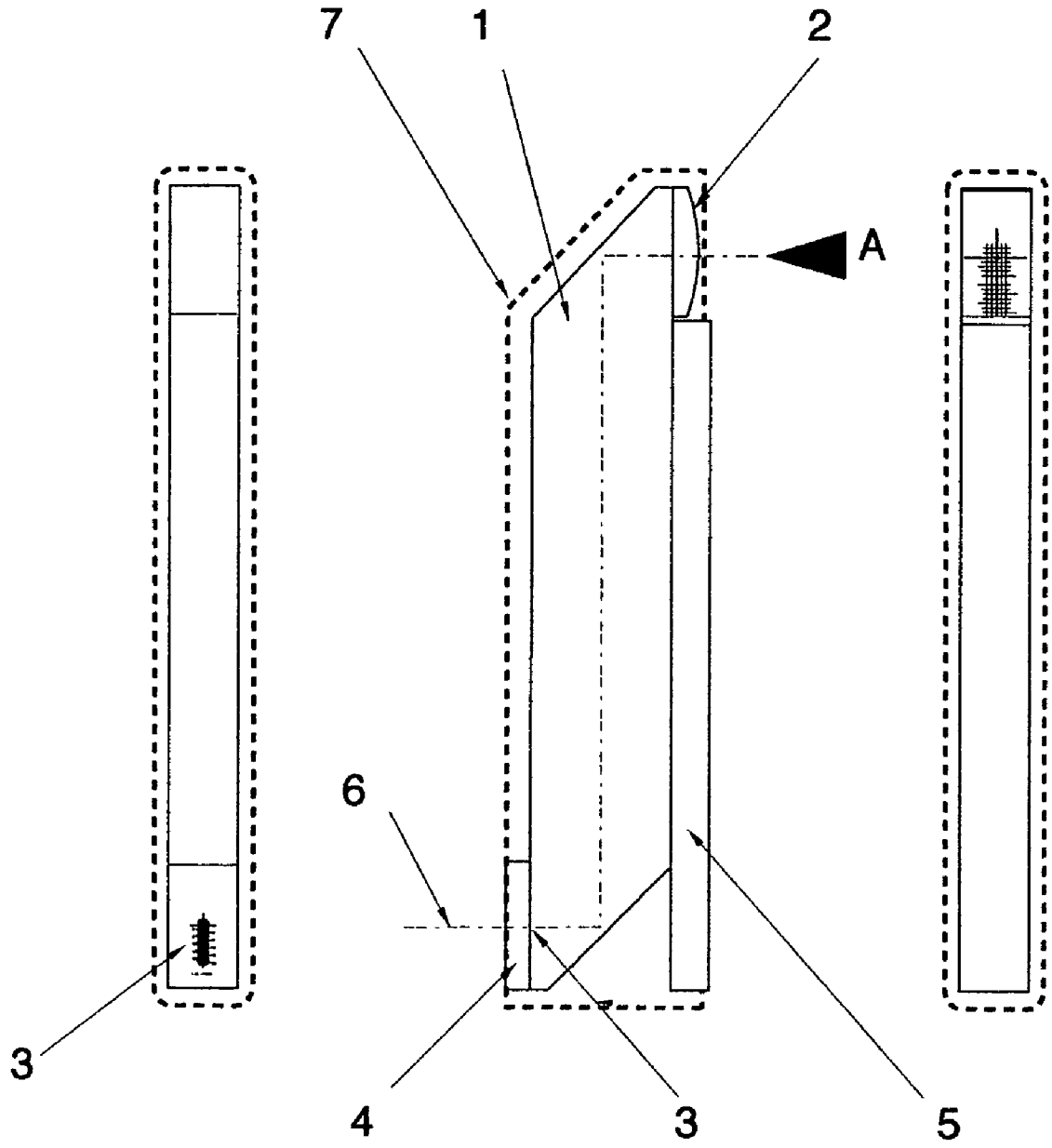
FIG. 1A back view of present invention.
FIG. 1B side view of present invention.
FIG. 1C front view of present invention.

FIG. 1B shows the glass reticule plate 4 with the marked reticule pattern is shown at 3, at the focal plane of the magnifying lens 2, and the optical path between them travels through a rhomboid prism 1. The optical path is reflected and turned at 90 degrees at the angled surfaces by prismatic internal reflection. The magnet 5 is fixed to the prism 1.

FIG. 1C shows the image of the reticule pattern 3 as seen in the optic 2 when viewed in the direction of arrow A. The collimator 7, is shown with an optional protective cover.

Figure 2A:
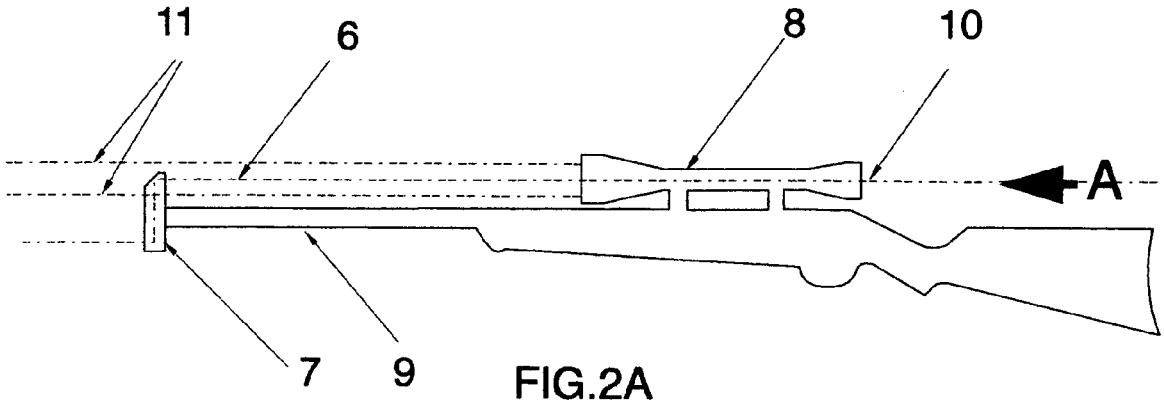
FIG. 2A side view of present invention mounted on rifle.

FIG. 2A shows the present invention 7 mounted on the muzzle of a rifle barrel 9. The riflescope 8 is viewed along sight line 10 and light rays from the target area 11 combine with rays 6 from the collimator 7, and enter the riflescope. Significantly, due to the optical design of the present invention, collimator 7, when a target is viewed with the magnifying riflescope 8, it is possible for multiple images to be seen.

Figure 2B:
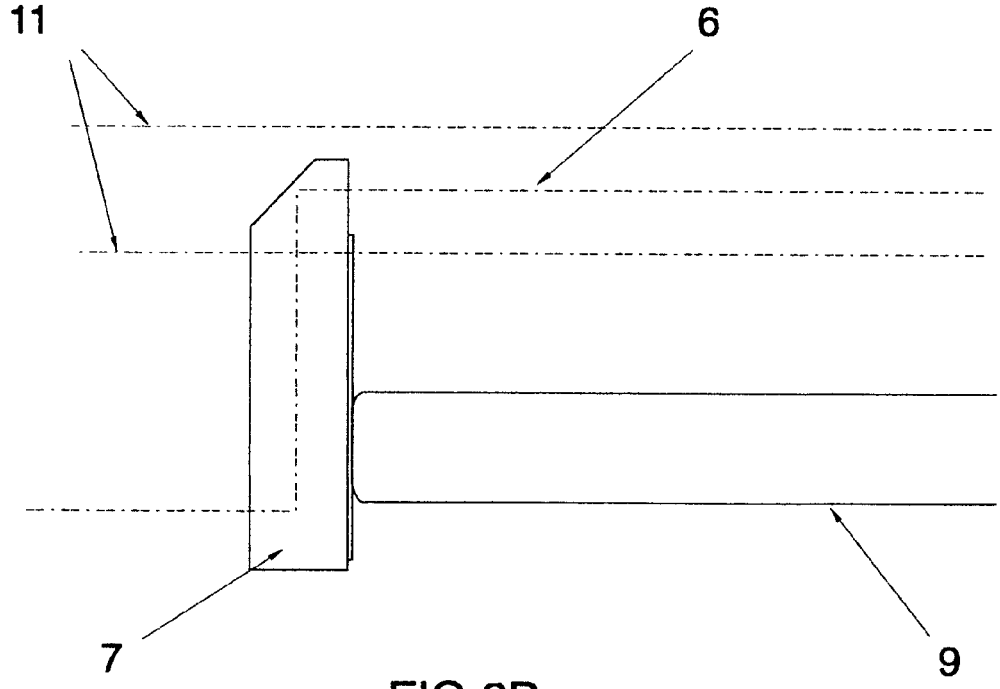
FIG. 2B enlarged side view of present invention mounted on rifle.

FIG. 2B shows an enlarged view showing light rays 11 from target area combining with light rays 6 travelling through the collimator 7.

Figure 3A:
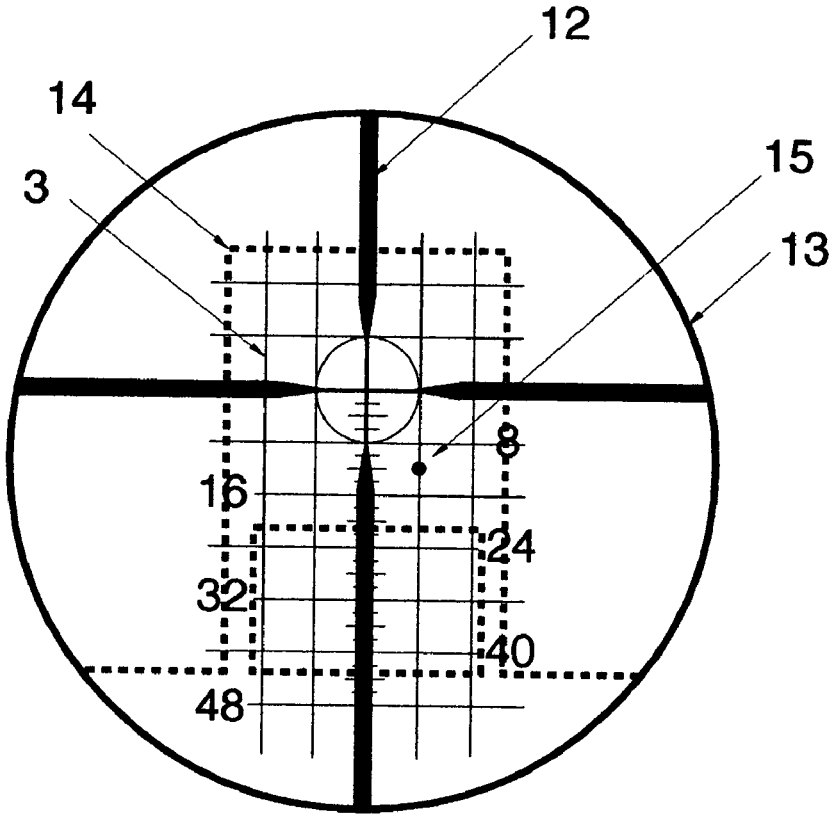
FIG. 3A front view of present invention mounted on rifle seen through a telescopic sight.

FIG. 3A shows a view as seen through the riflescope eyepiece 13, where the image of the target 14 is seen in conjunction with the collimator reticule image 3 and the cross wires 12 of the riflescope. This is of great benefit to the shooter as the combined view of the reticule pattern against the target makes adjusting the zero of the riflescope very simple to achieve.

Figure 3B:
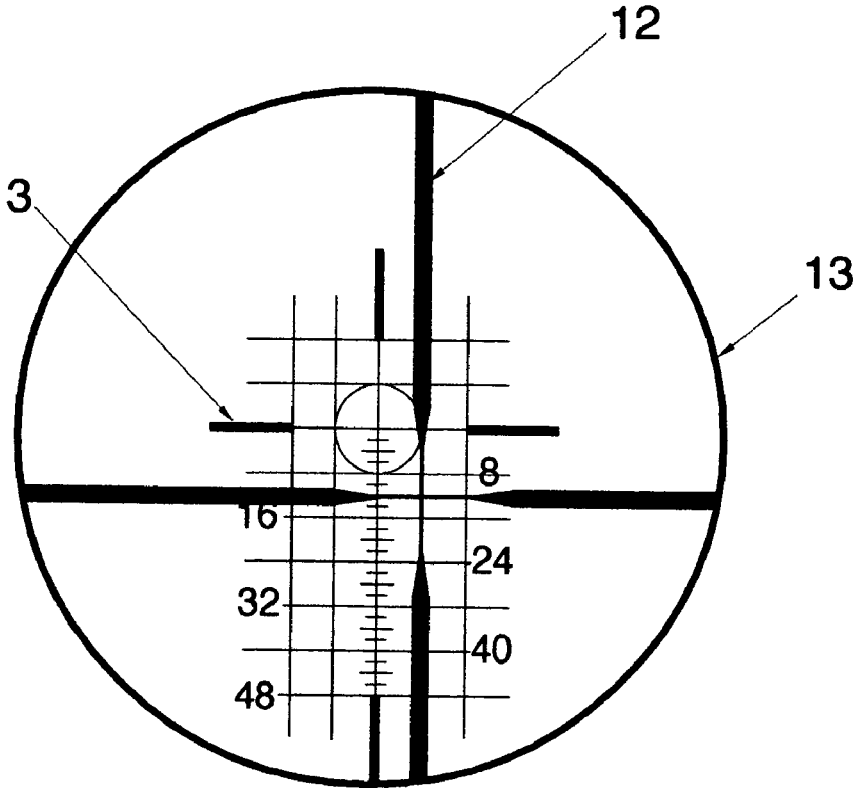
FIG. 3B front view of present invention mounted on rifle seen through a telescopic sight.

The cross wires 12 are initially set centred on the reticule pattern 3. After a shot is fired at the centre of the target, the cross wires 12 are simply adjusted to the point of impact of the bullet 15, while the reticule pattern is held centred on the target. FIG. 3B shows the cross wires moved to this position.

The reticule pattern can also be used to determine target range and to directly measure bullet drop at long ranges. This can be used to determine bullet muzzle velocity when these measurements are compared with exterior ballistic tables.

The range scale is not affected by the magnification of the riflescope as the target is also magnified by the same amount, and hence gives a true scale indication at any magnification.

FIG. 3B shows an alternative view of the reticule pattern and riflescope cross wires. The riflescope cross wires 12 are seen against the reticule pattern 3. This view can also be obtained by the present invention, if the riflescope is pointed away from the target, to something plain that has no features, such as the sky.

The position of the cross wires can be referenced against a range card which has a copy of the reticule pattern marked on it, with the required cross wire setting marked for a particular range.

I claim:

1. An optical collimator device for aligning a riflescope with a bore of a rifle barrel comprising, a reticule mounted to a block of optically clear material, a lens mounted to said block of optically clear material for viewing said reticule and providing a reticule image, forming a collimator, and where said block of optically clear material has internal reflecting surfaces that form a longer section and a shorter section of an optical path and aligns the longer section of the optical path between said reticule and said lens, to be perpendicular to the bore of the rifle barrel, and said collimator arrangement when viewed with said riflescope, allows a target to be viewed simultaneously with said reticule image.

2. A collimator as in claim 1, where said collimator is provided with a magnetic strip that allows mounting of said optical collimator to the said barrel of rifle and allows vertical adjustment of the collimator relative to the bore of said barrel, where said vertical adjustment does not disturb the optical alignment of said riflescope with the image of said reticule pattern.

3. A collimator as in claim 1, where the optically clear block is made from glass.

4. A collimator as in claim 1, where said lens is made from glass.

5. A collimator as in claim 1, where said reticule pattern is marked onto a glass surface.

6. A collimator as in claim 2, where the magnetic strip is made from a Neodymium alloy.

* * * * *